United States Patent [19]

Stelter et al.

[11] Patent Number: 5,051,780

[45] Date of Patent: Sep. 24, 1991

[54] FUSING TEMPERATURE CONTROL DEVICE FOR A PRINTER OR SIMILAR APPARATUS

[75] Inventors: Eric C. Stelter; Allan R. Amering; Michael G. Beyerlein, all of Rochester, N.Y.

[73] Assignee: Eastman Kodak Company, Rochester, N.Y.

[21] Appl. No.: 602,541

[22] Filed: Oct. 24, 1990

[51] Int. Cl.[5] ..... G03G 21/00; G03G 15/20

[52] U.S. Cl. ..... 355/208; 219/216; 355/285

[58] Field of Search ..... 355/208, 285, 290; 432/60; 219/216, 469, 470, 471

[56] References Cited

U.S. PATENT DOCUMENTS 4,429,990 2/1984 Tamary .
4,737,818 4/1988 Tanaka et al. ..... 355/290

FOREIGN PATENT DOCUMENTS 62-86384 4/1987 Japan .
62-217255 9/1987 Japan .

*Primary Examiner*—A. T. Grimley
*Assistant Examiner*—Shuk Y. Lee
*Attorney, Agent, or Firm*—Leonard W. Treash, Jr.

[57] ABSTRACT

An apparatus forms unfixed toner images on receiving sheets and fixes the images using a fuser having at least one heated roller. A temperature control means for the roller has a run set point and a standby set point. The apparatus monitors the formation of images. If the formation is interrupted, which would result in a skipped sheet at the fuser, set point for the fuser is adjusted toward the standby set point. The invention is particularly usable in a printer in which skip frames develop because a raster image processor is unable to form pages as fast as the printer can print pages.

3 Claims, 2 Drawing Sheets

FUSING TEMPERATURE CONTROL DEVICE FOR A PRINTER OR SIMILAR APPARATUS

TECHNICAL FIELD

This invention relates to apparatus for fusing toner images to receiving sheets. More specifically, it relates to an apparatus for controlling the temperature of a heated roller fuser during printing or copying runs.

BACKGROUND ART

U.S. Pat. No. 4,429,990, issued Feb. 7, 1984 to E. J. Tamary, shows an electrophotographic copier which forms a series of toner images, transfers those images to the opposite sides of receiving sheets and fuses both toner images to the receiving sheets simultaneously. The fuser in the Tamary apparatus is a heated roller fuser with both rollers heated. In a commercially successful application of this fuser, the rollers each have elastomeric coverings. To control the temperature of the rollers, a metallic core is sensed outside the image area of each roller and a heating lamp is regulated in each roller according to the temperature sensed.

In simplex operation, the apparatus feeds sheets to the fuser at a constant full machine rate with a small interframe between the sheets. In this condition, a large amount of heat is absorbed by the paper from the fuser. Accordingly, "run" set points during a continuous simplex run are relatively high. During duplex operation, the sheets are fed to the fuser also at a constant rate but one-half that of the simplex rate. There thus is a space of at least one sheet between sheets. As a result, "run" set points for duplex are somewhat lower than for simplex.

When the apparatus is on but no copies are being made, the temperature set points are at a lower "standby" temperature. Each temperature set point is designed to produce a temperature of 340° F. at the fusing surface of the rollers when they are contacting images. The higher set points during run in either simplex or duplex are designed to maintain that temperature despite heat being carried out of the fuser by the sheets.

This commercial copier produces excellent copies with this approach. However, in applying this principle to a similarly designed highspeed, high-quantity printer, it was found that occasionally the speed of the printer exceeded the ability of the printer electronics to format image pages. Accordingly, in the middle of a run, the printer would stop printing for one or more frames. If the fuser was set at its run set points, but no sheets were coming through the fuser, the surface of the fusing rollers have a tendency to overheat. Using toners with a fusing temperature of 340° F., serious problems were not caused. However, in adapting the printer to a higher fusing temperature toner, for example, 380° F., such overheating occasionally would activate a temperature shutdown sensor, char the paper or cause hot offset of the toner.

Frames containing no image (sometimes called "skip frames") commonly occur when a raster image processor that converts information from, typically, ASCII Code, into a bit map does not keep up with the process speed of the printer. Similar situation at a fuser will occur if multicolor images are being formed in which a number of images are combined on a single side of a sheet, thereby reducing the throughput of the fuser during a run.

DISCLOSURE OF THE INVENTION

The object of the invention is to improve temperature control of a fuser which has an interruption in sheets fed to it during a run.

This object is accomplished by creating a signal indicative that there is an interruption in an otherwise constant rate of sheets being fed to a fuser and adjusting at least one of the set points of the fuser toward its standby set point in response to such a signal.

This invention is applicable to either simplex or duplex fusers. According to a preferred embodiment, a simplex roller which has simplex run, duplex run, and standby set points is adjusted when receiving a first interruption signal from its simplex run set point to its duplex set point and then adjusted from the duplex set point to its standby set point in response to receiving a second interruption signal.

According to a preferred embodiment, when applied to a fuser in which two rollers are independently heated, the set point of one of the rollers is adjusted toward standby. When the standby set point is reached for that roller, the other roller is adjusted toward standby.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
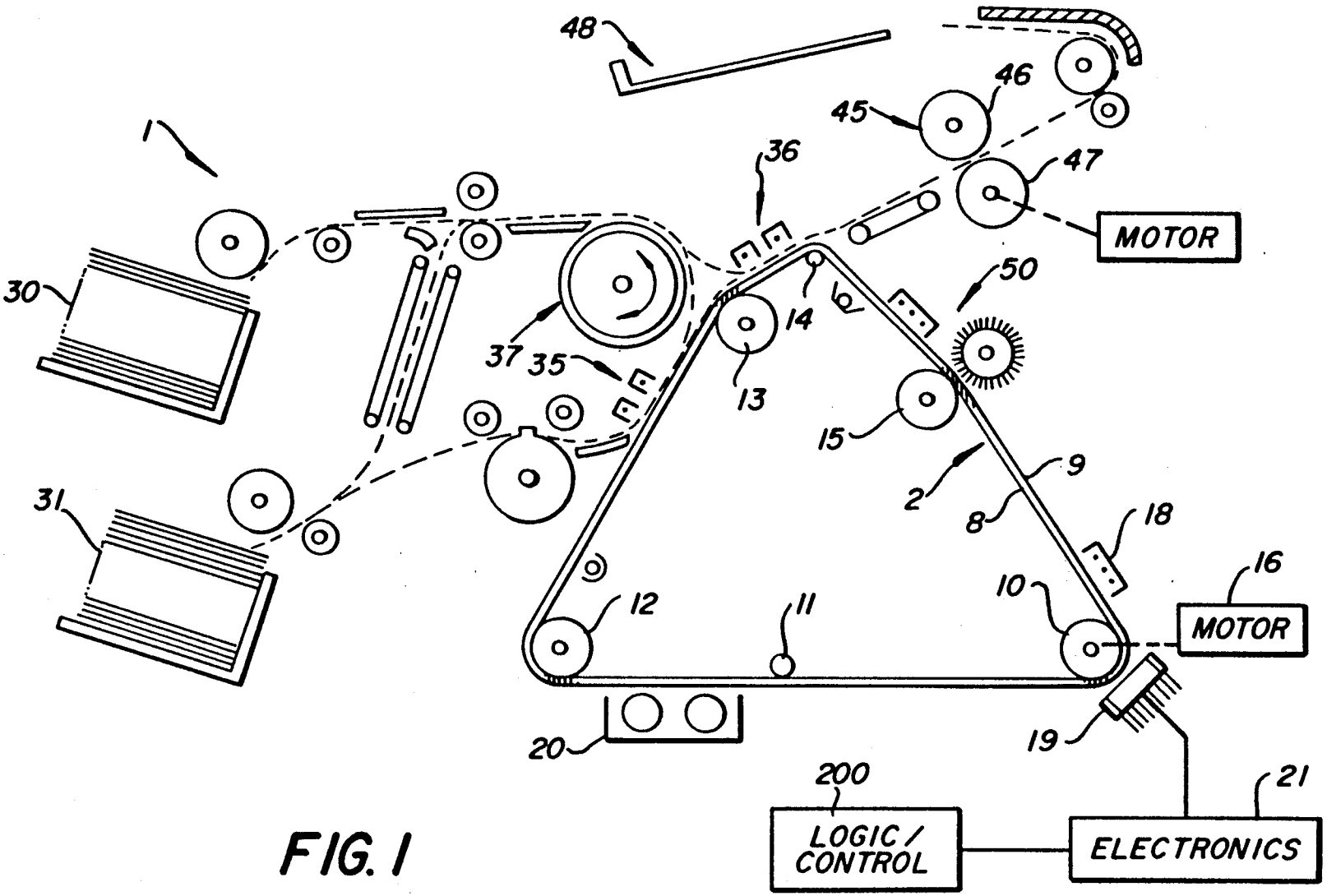
FIG. 1 is a side schematic of an apparatus illustrating the invention.

FIG. 1 shows an electrophotographic printer 1 which uses the principle of single pass duplexing. According to FIG. 1, an image member 2 is an endless belt having one or more electrophotosensitive layers 9 on a conductive backing 8. Image member 2 is entrained about a series of rollers 10, 11, 12, 13, 14 and 15 and is driven past a series of stations by a motor 16 connected to roller 10. Image member 2 is uniformly charged at a main charging station 18, imagewise exposed at an electronic exposure station 19 to create a series of electrostatic images in response to an electronic signal coming from an electronic source 21 which electronic source can be a computer, a scanner, a memory, or the like. The series of electrostatic images on image member 2 are toned at a toning station 20 to create a series of toner images defined by the electrostatic images.

Printer 1 has a pair of transfer stations 35 and 36 for transferring toner images to receiving sheets fed from either of receiving sheet supplies 30 or 31. If simplex output is desired, receiving sheets are fed from either of receiving sheet supplies 30 or 31 to second transfer station 36 where the receiving sheets arrive in timed relation with the toner images and are transferred by conventional corona transfer. The receiving sheets separate from image member 2 as image member 2 passes around small roller 14 and are transported to duplex fuser 45 which include rollers 46 and 47. The simplex images are fused by application of heat and pressure by rollers 46 and 47 and transported through an inversion to arrive face up in an output hopper 48. Image member 2 is cleaned at cleaning station 50 for reuse.

If duplex output is desired, receiving sheets are fed from receiving sheet supply 31 to first transfer station 35 where a first side of the receiving sheet receives a first toner image. The receiving sheet is separated from image member 2 and turned over by a turnover roller 37 and immediately fed back to second transfer station 36 to receive a second toner image on its opposite side. The receiving sheet again separates from image member 2 as image member 2 passes around small roller 14 and is transported to fuser 45 where both images are simultaneously fused to opposite sides of the sheet and then deposited with its first side up in output tray 48.

Figure 2:
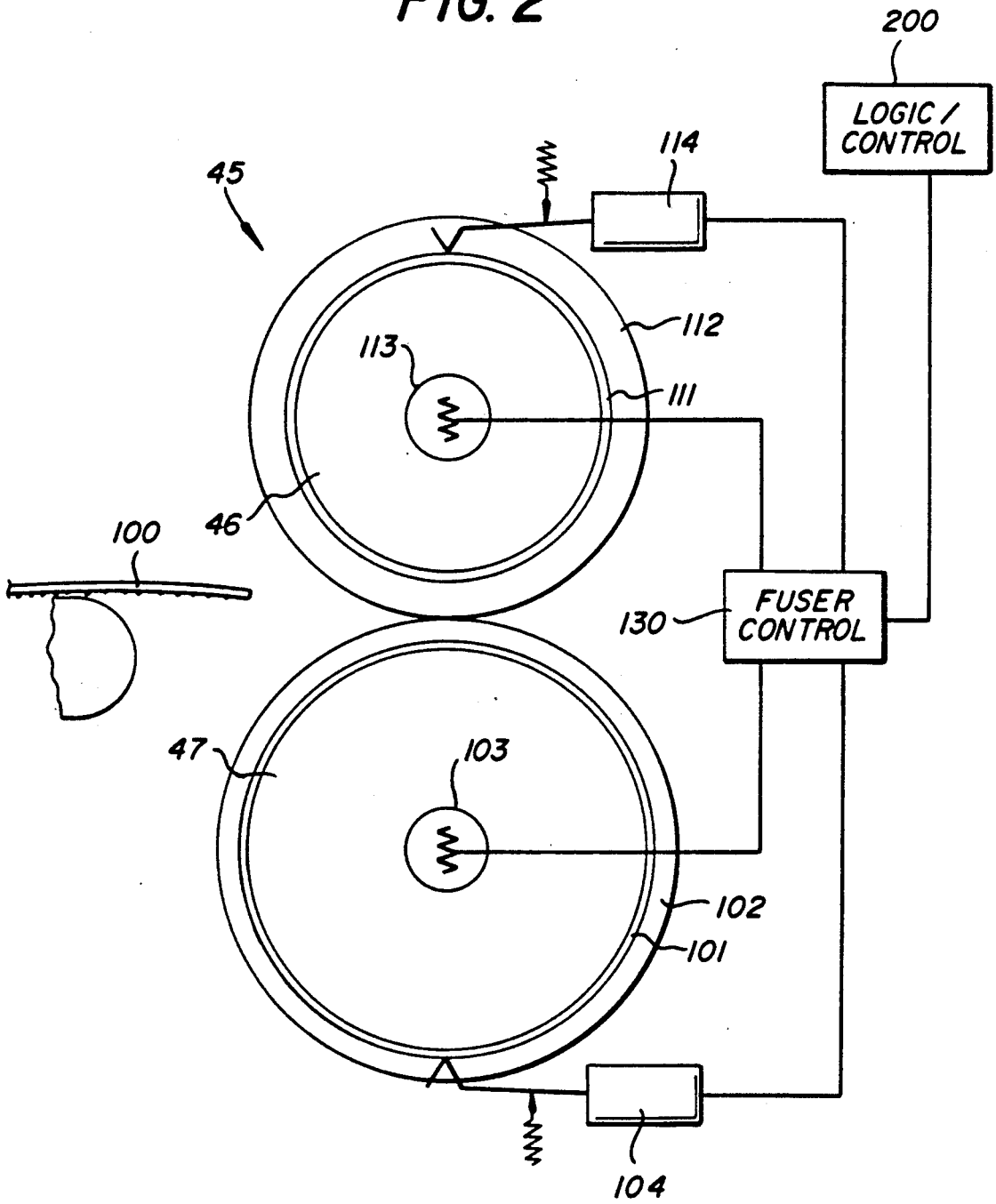
FIG. 2 is a side schematic section of a fuser portion of the apparatus shown in FIG. 1.

Fuser 45 is shown in more detail in FIG. 2. According to FIG. 2, first fusing roller 47 contacts the image side of a receiving sheet 100 carrying a simplex image and is commonly called the "simplex roller." Simplex roller 47 has a metal core 101 and is preferably covered by a thin elastomeric covering 102 of a material which defines the outside surface of simplex roller 47 which surface is resistant to offset of toner. For example, the elastomeric material can be a conventional silicone rubber presently used in fusers.

The simplex fusing roller 47 is heated by a short filament quartz lamp 103 which preferably does not stretch to the ends of the roller 47. Lamp 103 is preferably relatively high power. For example, for fusing legal-sized sheets having a cross-track dimension of 14 inches and standard sized sheets having a cross-track dimension of 11 inches, lamp 103 can be powered by 1850 watts across a 14¼ inch filament.

Second fusing roller 46, commonly called the "duplex roller," has a metal core 111 similar to core 101 in first roller 47. It is covered with a relatively thick elastomeric coating and is heated by a somewhat less powerful but longer lamp 113. For example, lamp 113 can be powered by 1250 watts across a 16 inch filament.

Elastomeric layer 102 is sufficiently thin, for example, 20 mils, to make simplex roller 47 relatively hard compared to duplex roller 46 whose elastomeric layer 112 is thicker, for example, 100 mils. Rollers 46 and 47 thus form a nip which is curved into the duplex roller, approximately conforming to the cylindrical (uncompressed) outer periphery of first roller 47. The temperature of core 101 is monitored by a temperature sensor 104 and the temperature of core 111 is monitored by a temperature sensor 114 whose outputs are fed to a fusing control 130 which in turn controls the power supplied to lamps 103 and 113.

During simplex fusing, printer 1 produces simplex output at full machine speed. That is, receiving sheets have images transferred to them and enter the fuser at a rate approximating that of the movement of image member 2 with a small, for example, less than 1 inch, space between sheets. Core 101 for simplex roller 47 has a simplex set point at a temperature sensed by sensor 104 that is high enough to fuse images at this rate taking into consideration the thickness of thin layer 102. Duplex roller 46 is heated by heat lamp 113 to supply some heat to the process, which reduces the amount of heat lost by the simplex roller 47 between the receiving sheets. However, the duplex roller 46 does not have a set point that would by itself be consistently high enough to fuse images on the back side of receiving sheet 100.

In single pass duplex operation, sheets are received from image member 2 at a consistent, every-other-frame, rate. That is, consecutive receiving sheets are separated by a gap equal, at least, to the in-track dimension of a receiving sheet. During this time, heat from the simplex roller 47 transfers to the duplex roller 46, thereby raising the exterior temperature of duplex roller 46 above that attributable to the heat from core 111. The heat from simplex roller 47 raises the temperature of the surface of duplex roller 46 adequately to allow roller 46 (with the heat received from its heat source 113) to fuse images carried on the back of a duplex receiving sheet while the simplex roller fuses images on the front side of the receiving sheet.

This system has the advantage of supplying much of the heat for both simplex and duplex fusing from the simplex roller 47. Simplex roller 47 has the thin elastomeric cover 102 and therefore readily transfers heat to the nip.

This approach permits running at higher throughput and/or higher roller surface temperatures, without excessive roller core temperatures. At the same time, heat is more effectively utilized and therefore the fuser heats up the environment less than prior duplex fusers.

Although both rollers 47 and 46 have elastomeric layers in the preferred embodiment shown in FIG. 2, roller 47 could have only a thin layer of offset preventing material such as polytetrafluoroethylene directly on core 101. To assure comparable appearance of both images in duplex, roller 46 should then have a coating of the same offset preventing material on elastomeric layer 112.

In the prior art duplex fuser presently in use, which has a 100 mil and a 20 mil elastomer coatings on simplex and duplex rollers, respectively, core set points on the simplex and duplex rollers when in standby are approximately 345° F. and 330° F., respectively. For 11 inch simplex receivers these set points are increased to simplex run set points of approximately 415° F. and 340° F., respectively. The surface temperature of the simplex roller can droop to as low as 305° F. at startup using these parameters, with a power consumption as high as 2500 watts. This device is designed for use with toners having a desired fusing temperature of 340° F.

In a fuser constructed as shown in FIG. 2 standby set points of 340° F. and 366° F. are used for simplex and duplex rollers, respectively. These are increased to 395° F. and 415° F., respectively, during a simplex run. This provides a steady state surface temperature on the simplex roller of approximately 380° F. with little droop and maximum overshoot to about 395° F. Using these set points, the duplex roller surface temperature is maintained between 340° F. and 350° F. during simplex operation.

In duplex, the duplex roller set point is allowed to remain at 415° F. while the simplex roller set point is reduced to 375° F. This maintains the surface temperature of each roller at between 380° F. and 390° F. for duplex fusing, again with negligible droop.

The temperatures in each mode are maintained with an average power consumption less than 2500 watts. This structure is designed for use with a toner having a preferred fusing temperature of about 380° F.

Thus, the FIG. 2 fuser provides more even fusing with less droop and danger of overheating than the prior art despite increasing the fusing temperature from 340° F. to 380° F. This structure therefore allows use of a higher fusing temperature toner in the FIG. 1 apparatus.

The surface temperatures are measured in the middle of the image while the core set points are dependent upon sensors in the margins outside of the images which tend to be cooler than the middle of the core. This explains the simplex roller core set point in duplex being lower than either roller surface temperature.

The specific examples of set points set out above are for 11 inch receiver sheets. Higher set point for 13 or 14 inch receiving sheets are required to provide essentially the same fusing temperature at each surface. This adjustment between letter and legal or other size sheets is a feature presently known in the art.

Note that apparatus 1 is shown as a printer using an LED printhead 19 connected to a source 21. The fuser according to FIG. 2 could also be used with an optical copier similar to that shown in U.S. Pat. No. 4,429,990, referred to above.

If the source 21 is a computer which is generating data at a rate that, in some instances, due to its complexity does not keep up with the speed of the printer 1, a logic and control 200 of printer 1 may add one or more skip frames to its processing cycle. That is, until the data stream being fed by source 21 into printhead 19 is complete, one or more frames may not be imaged. If this happens continually in either simplex or duplex operation, the fuser 45 may run without sheets passing through it, but with a higher "run" set point. This will cause overheating of the fuser with known problems, such as "hot offset", charring of paper and overheating shutdown by safety sensors (not shown).

To solve this problem, logic and control 200, for the apparatus can be programmed to adjust the set point(s) in fuser control 130 in a downward direction in response to the occurrence of skip frames.

This approach involves decreasing the core temperature set points from simplex values (used for maximum heat loss conditions) to standby values (used for minimum heat loss conditions) as a function of the number of skip frames per fused receiver. A fuser roller consisting of a elastomeric coating on a metal core can be modeled as a hollow cylinder, which is the coating, with the inner surface held at a uniform temperature equal to the temperature of the core. According to well known thermal equations, the flow of heat per unit length of the cylinder is equal to:

$$2\pi K(v_1 - v_2)/1n(b/a)$$

where K is the thermal conductivity of the elastomer, $v_1$ and $v_2$ are the temperatures of the inner and outer surfaces of the cylinder and a and b are the radii of the inner and outer surfaces of the cylinder. From this it can be seen, that, if the outer surface at b is to be kept at $v_2$ and the heat flow out of the system is reduced (for example, due to skip frames), then the difference $(v_1 - v_2)$ must be reduced proportionally to reduce the flow of heat to the outer surface to keep $v_2$ from increasing. It is also apparent that the heat flow from a roller with a thick elastomeric coating is less than that of a thinly coated roller. Therefore, one method of controlling roller surface temperature is to first decrease the thinly coated simplex roller set point incrementally toward standby. Once the standby position is reached for the simplex roller, the duplex roller is reduced incrementally to standby. For example, for one skip frame the simplex roller is set to a value necessary to maintain constant net heat flow and roller surface temperatures at the aim fusing temperature. For two skip frames it is decreased slightly more, and so on, until the standby values for both rollers is reached.

However, in actual practice, this much sophistication does not appear to be necessary. The printer shown in FIG. 1 may have five or six image frames. Logic and control 200 receives three inputs relevant to fuser control, the appearance of a frame indicator at a sensing point relevant to exposure, an indication as to whether exposure is to be made for that frame, and an indication as to whether printing will be in duplex or not (simplex). In response to the frame indication signal, if the frame is to be exposed and printed in simplex, the fuser is set at its simplex run set points. In response to a frame indication signal and an exposure indication signal with printing set at duplex, the temperature set points are positioned for duplex. If a frame indication signal is received and no exposure signal is received, the logic and control immediately sets the fuser set points down "one skip frame increment", unless both rollers' set points are already at standby, in which case no further adjustment is made.

Note that the fuser is immediately adjusted even though the frame to be skipped is four or five frames away from the fuser (the distance between the exposure station and the fuser). Four frames in a high speed printer may be equal to two or three seconds of time. Actual heat adjustment in this time is not fast enough to make a serious difference. However, if a series of skip frames occurs, definite overheating can result when sheets stop arriving at the fuser which this algorithm will adjust for.

A specific example of an approach to incremental setting of the fuser shown in FIG. 2 in response to skip frames is to adjust the simplex roller set point to its duplex value on occurrence of the first skip frame, then adjust the simplex roller to the standby value at the second skip frame. Then the duplex roller is adjusted to the standby value for the third and subsequent frames. A less precise approach would be to adjust both rollers to the standby at the first skip frame. Both of these approaches substantially eliminate hot offset in a conditiion of a substantial and unpredictable skip frames. When the raster image processor catches up, an image is exposed, the fuser returns to its run set points.

Note that this algorithm for handling skip frames is not limited to single color printers. In printers that run often with a single color but occasionally combine images from consecutive frames onto a single side of a single sheet will also generate a condition similar to skip frames. That is, the flow of paper through the fuser will stop for a while. This invention can be used for such conditions. Note that the absence of paper in the fuser that causes the increase in temperature in a color copier or printer is due to superposing multiple frames on a single side of a sheet, rather than skipping an exposure frame. Thus, it may be preferable to key off the feeding of sheets rather than exposure as indicative of "skip frames", since exposure of images would not be a good indication of the paper passage through the fuser in this instance.

The invention has been described in detail with particular reference to a preferred embodiment thereof, but it will be understood that variations and modifications can be effected within the spirit and scope of the invention as described hereinabove and as defined in the appended claims.

I claim:

1. A toner image forming apparatus comprising:

means for forming unfixed toner images on either one side of a receiving sheet or on both sides of a receiving sheet, and for feeding said sheets at a constant rate to a fuser, which constant rate when said sheets have images on both sides is approximately one-half the rate when the sheets have images on only one side, a fuser for receiving said sheets and applying heat and pressure to said images to fix said images to said sheets, said fuser including first and second heated rollers, control means for sensing the temperature associated with each of said first and second heated rollers for controlling the surface temperature of said rollers in response to the temperature sensed, said control means having separate standby set points controlling the temperature of each roller when no images are being formed and separate run set points higher than said standby set points for controlling said temperature of each of said rollers when images are being formed, said first roller having first and second run set points, the first run set point being used when sheets are being fed having images on one side and the second run set point being used when sheets are being fed having unfixed images on both sides, said first run set point being higher than said second run set point, means for creating a signal indicative of a temporary interruption in said constant rate of sheets being received at said fuser, and means for adjusting the set point on said first roller to its second run set point in response to a first interruption signal and to its standby set point in response to a second interruption signal.

2. Apparatus according to claim 1 wherein said means for adjusting adjusts said second point on the second roller from its run set point to its standby set point in response to a third interruption signal.

3. The apparatus according to claim 1 wherein said means for creating an interruption signal includes means for monitoring the formation of an image by said image forming means.

* * * * *